US008385780B2

(12) United States Patent
Nakamura et al.

(10) Patent No.: US 8,385,780 B2
(45) Date of Patent: Feb. 26, 2013

(54) CHARGING MEMBER, CHARGING DEVICE INCLUDING THE CHARGING MEMBER, PROCESS CARTRIDGE INCLUDING THE CHARGING DEVICE AND IMAGE FORMING APPARATUS INCLUDING THE PROCESS CARTRIDGE

(75) Inventors: Makoto Nakamura, Ebina (JP); Yutaka Narita, Sagamihara (JP); Tadayuki Oshima, Atsugi (JP); Hiroki Furubayashi, Atsugi (JP); Taisuke Tokuwakt, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 436 days.

(21) Appl. No.: 12/709,874

(22) Filed: Feb. 22, 2010

(65) Prior Publication Data

US 2010/0215400 A1 Aug. 26, 2010

(30) Foreign Application Priority Data

Feb. 24, 2009 (JP) ..... 2009-040863

(51) Int. Cl.
*G03G 15/02* (2006.01)

(52) U.S. Cl. ..... 399/176

(58) Field of Classification Search ..... 399/176, 399/174, 168; 430/902; 361/221, 225
See application file for complete search history.

(56) References Cited

U.S. PATENT DOCUMENTS

| | | | |
|---|---|---|---|
| 2008/0101819 | A1 | 5/2008 | Nakamura et al. |
| 2009/0042117 | A1 | 2/2009 | Nakamura et al. |
| 2010/0014891 | A1 * | 1/2010 | Sakata ..... 399/176 |

FOREIGN PATENT DOCUMENTS

| | | |
|---|---|---|
| JP | 2000-291634 | 10/2000 |
| JP | 2007-1222 | 1/2007 |
| JP | 4047056 | 11/2007 |
| JP | 2008-111872 | 5/2008 |
| JP | 2009-42550 | 2/2009 |

* cited by examiner

*Primary Examiner* — Sophia S Chen
(74) *Attorney, Agent, or Firm* — Cooper & Dunham LLP

(57) ABSTRACT

A charging member, includes: an electrically-conductive support; an electrical resistance adjustment layer having ion conductivity provided on the electrically-conductive support; an intermediate layer having ion conductivity provided on the electrical resistance adjustment layer; and a surface layer having insulation provided on the intermediate layer, wherein the intermediate layer is formed of a resin composition containing at least a polyether polyol resin, and the surface layer is formed of a resin composition containing at least one of a fluorine-based resin, a silicone-based resin, a polyamide resin, a polyester resin, and a urethane resin.

10 Claims, 5 Drawing Sheets

CHARGING MEMBER, CHARGING DEVICE INCLUDING THE CHARGING MEMBER, PROCESS CARTRIDGE INCLUDING THE CHARGING DEVICE AND IMAGE FORMING APPARATUS INCLUDING THE PROCESS CARTRIDGE

CROSS REFERENCE TO RELATED APPLICATIONS

This application claims priority from Japanese Patent Application No. 2009-040863, filed with the Japanese Patent Office on Feb. 24, 2009, the contents of which are incorporated herein by reference in their entirety.

BACKGROUND OF THE INVENTION

The present invention relates to a charging member used in an image forming apparatus of a copier, a laser beam printer, a facsimile and the like, also to a charging device including the charging member, a process cartridge including the charging device and an image forming apparatus including the process cartridge.

A charging device that performs a charging process on an image carrier (photoreceptor drum) is used in a conventional electro-photo type image forming apparatus of an electronic photo-copier, a laser printer, a facsimile and the like. FIG. 8 is an explanatory diagram of an electrophotographic-type image forming apparatus having a conventional charger roller.

In FIG. 8, 130 is a conventional electrophotographic-type image forming apparatus. The conventional electrophotographic-type image forming apparatus 130 includes a photoreceptor drum 111 in which an electrostatic latent image is formed, a charging member (charger roller) 112 that performs the charging process by contacting the photoreceptor drum 111, an exposure device 113 of a laser beam or the like, a toner carrier (development roller) 114 that makes toner 115 to adhere onto the electrostatic latent image of the photoreceptor drum 111, a transfer member (transfer roller) 116 that transfers a toner image on the photoreceptor drum 111 onto a recording paper 117 and a cleaning member (cleaning blade) 118 for cleaning the photoreceptor drum 111 after the transfer process. In the FIG. 8, 119 are eliminated toners obtained from removing residual toners on a surface of the photoreceptor drum 111 by the cleaning member 118, 120 is an image development device and 121 is a cleaning device. In addition, in the FIG. 8, functional units normally necessary at other electrophotographic processes are not necessary in the present specification and are thereby abbreviated.

Next, basic image forming operations of the image forming apparatus 130 of the conventional electrophotographic-type will be described.

When DC voltage is fed from a power package (not illustrated) to the charger roller 112 which is in contact with the photoreceptor drum 111, the surface of the photoreceptor drum 111 is charged uniformly to a high electric potential. Soon afterwards, when image light is radiated by the exposure device 113 onto the surface of the photoreceptor drum 111, an electric potential of a part radiated by the photoreceptor drum 111 decreases. Such a charging mechanism by the charger roller 112 towards the surface of the photoreceptor drum 111 is known as an electrical discharge (spark discharge) based on Paschen's Law, in a minute space between the charger roller 112 and the photoreceptor drum 111.

Image light refers to light quantity distributions corresponding to black/white of an image. When the image light is radiated, due to radiation of the image light, an electrical potential distribution corresponding to a recorded image, that is, an electrostatic latent image is formed on a surface of the photoreceptor drum 111. Thus, when a part of the photoreceptor drum 111 having the electrostatic latent image formed passes through the development roller 114, toners are adhered corresponding to highs and lows of the electrical potential and a toner image visualizing the electrostatic latent image is formed. The recording paper 117 is carried at a predetermined timing by a registration roller (not illustrated) to the part of the photoreceptor drum 111 having the toner image formed to overlap the toner image. Then after the toner image is transferred onto the recording paper by the transfer roller 116, the recording paper 117 is separated from the photoreceptor drum 111. The separated recording paper 117 is carried through a paper path. The recording paper 117 is then fused by a fuser unit (not illustrated) to be ejected outside the machine. When transfer is finished in this manner, a cleaning process is performed on the surface of the photoreceptor drum 111 by the cleaning member 118. Furthermore, residual electric charges are removed by a quenching lamp (not illustrated) to prepare for the next image forming process.

As for a charging member used in the above-described image forming apparatus, a charging-by-contact type is widely used in which the charging member contacts the surface of the image carrier so that the surface of the image carrier is charged. There is a problem such that during usage of the charging member, adherent substances such as residual toners on the surface of the image carrier, toners deteriorated due to oxidized gas generated by the electrical discharge of the charging member and toner constituent substances or the like adhere to the surface of the charging member so that the charging member is smeared. Therefore, in order to remove these adherent substances, the cleaning member is disposed on the surface of the charging member. However, the cleaning member becomes smeared over time by the adherent substances removed from the charging member by the cleaning member so that cleaning capabilities of the cleaning member decrease. Therefore, electrical discharge irregularities are generated by the adherent substances adhered to the charging member and there is a problem such that abnormal images are generated.

Consequently, a charging-by-noncontact type charging member to charge the surface of the image carrier is gradually adopted in the above-described image forming apparatus in which the charging member is disposed to be in close contact with the image carrier with a certain space (minute gap) maintained between the charging member and the image carrier. In a case where the charging-by-noncontact type charging member is used, the charging member is not in direct contact with the image carrier so that it becomes difficult for the surface of the charging member to be tainted. Therefore, the charging-by-noncontact type charging member can have a longer life than the charging-by-contact type charging member.

As for the charging-by-noncontact type charging member, a minute gap is formed between the image carrier and the charging member and the minute gap is approximately equal to or less than 100 μm. Therefore, if a foreign substance such as a dust particle larger than the minute gap becomes trapped in the minute gap, there is a problem of generating an abnormal image caused by a poor electrification. In particular, in a part where the foreign substance is adhered, there is a problem of generating a black spotty image due to a low charged potential. In a charging member, a high AC (alternating-current) voltage is applied superimposedly to a DC (direct-current) voltage, therefore it is necessary for the charging member to have electrical conductivity. In addition, high voltage is applied to the charging member, and therefore a partial abnormal electrical discharge easily occurs due to a leak. In order to reduce the above-described abnormal electrical discharge, it is more preferable to use an ion-conductive charging member to which a conductive additive such as an electrolyte salt as a quaternary ammonium salt is added and a charging member made from an epichlorohydrin rubber having electrical conductivity than to use an electron-conductive charging member to which a conductive additive such as a carbon black is added.

FIG. 9 is a cross-sectional diagram of a conventional charging member. As illustrated in FIG. 9, a conventional charging member 112 has an electrically-conductive support 112*c*, an electrical resistance adjustment layer 112*b* provided on the electrically-conductive support 112*c*, and a surface layer 112*a* provided on the electrical resistance adjustment layer 112*b* (see Japanese patent application publication number 2008-111872). In the conventional charging member 112, the surface layer 112*a* is formed of an ion-conductive material, and the surface layer 112*a* is soft and has a high coefficient of friction. Therefore, when a foreign substance becomes trapped in a minute gap between the charging member 112 and an image carrier, the foreign substance is buried (adhered) in a surface of the charging member 112, because the surface of the image carrier is hard and has a low coefficient of friction. And therefore there is a problem such that even a cleaning member which is in contact with the charging member is not able to remove the foreign substance. Consequently, a technique such that a powdered solid lubricant is applied to the surface of the charging member and coefficient of friction of the surface of the charging member is decreased and thereby the foreign substance adhering to the surface of the charging member is prevented is disclosed in Japanese patent application publication number 2009-42550, and thereby some preventive effects are obtained, however it is not sufficient to prevent the foreign substance from adhering to the surface of the charging member. This is because a hardness of the surface layer of the charging member is lower than that of the surface layer of the image carrier, and therefore the foreign substance is pushed to a side of the charging member and the foreign substance is buried in the surface of the charging member and it is not possible for even the cleaning member to remove the foreign substance.

SUMMARY

The present invention is made to solve the above problems.

That is, an object of the present invention is to provide a charging member, a charging device including the charging member, a process cartridge including the charging device, and an image forming apparatus including the process cartridge such that even when a foreign substance becomes trapped in a minute gap between the image carrier and the charging member, an occurrence of an abnormal image caused by the foreign substance being buried in the surface of the charging member is prevented.

In order to achieve the above object, embodiments of the present invention provide: a charging member comprising: an electrically-conductive support; an electrical resistance adjustment layer having ion conductivity provided on the electrically-conductive support; an intermediate layer having ion conductivity provided on the electrical resistance adjustment layer; and a surface layer having insulation provided on the intermediate layer, wherein the intermediate layer is formed of a resin composition containing at least a polyether polyol resin, and the surface layer is formed of a resin composition containing at least one of a fluorine-based resin, a silicone-based resin, a polyamide resin, a polyester resin, and a urethane resin.

In order to achieve the above object, embodiments of the present invention provide: a charging device comprising: the charging member described above.

In order to achieve the above object, embodiments of the present invention provide: a process cartridge which is fixed to a main body of an image forming apparatus to be freely detachable, comprising: the charging device described above, and an image carrier, wherein the charging member and the image carrier are supported integrally.

In order to achieve the above object, embodiments of the present invention provide: an image forming apparatus, comprising: the process cartridge described above; an exposure device which exposes and forms an electrostatic latent image on a surface of an image carrier; an image development device which visualizes the electrostatic latent image on the surface of the image carrier by supplying toners; and a transfer device which transfers onto a transfer medium the visualized electrostatic latent image on the surface of the image carrier.

DETAILED DESCRIPTION OF THE PREFERRED EMBODIMENTS

An embodiment of the present invention is described hereinafter with reference to the accompanying drawings.

Figure 1:
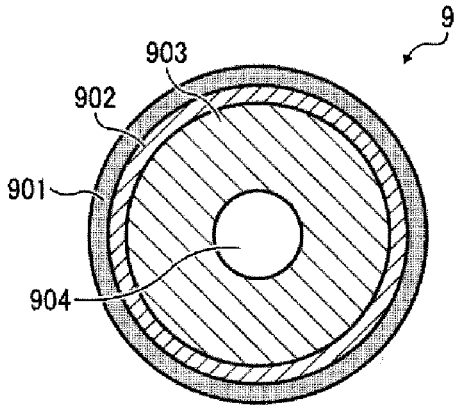
FIG. 1 is a cross-sectional diagram of a charging member (charger roller) according to an embodiment of the present invention.

In FIG. 1, numeral 9 is a charging member. The charging member 9 has an electrically-conductive support 904, an electrical resistance adjustment layer 903 having ion conductivity provided on the electrically-conductive support 904, an intermediate layer 902 having ion conductivity provided on the electrical resistance adjustment layer 903, and a surface layer 901 having insulation provided on the intermediate layer 902. And in the charging member 9, (a) the intermediate layer 902 is formed of a resin composition containing at least a polyether polyol resin, and (b) the surface layer 901 is formed of a resin composition containing at least one of a Fluorine-based resin, a silicone-based resin, a polyamide resin, a polyester resin, and a urethane resin.

Thus, in a case where the charging member 9 has the electrically-conductive support 904, the electrical resistance adjustment layer 903 having ion conductivity provided on the electrically-conductive support 904, the intermediate layer 902 having ion conductivity provided on the electrical resistance adjustment layer 903, and the surface layer 901 having the insulation provided on the intermediate layer 902 and in the charging member 9, since (a) the intermediate layer 902 is formed of a resin composition containing at least a polyether polyol resin, and (h) the surface layer 901 is formed of a resin composition containing at least a fluorine-based resin, a silicone-based resin, a polyamide resin, a polyester resin, or a urethane resin, the surface layer 901 is harder than the intermediate layer 902. And therefore, it is possible to provide a charging member 9 which prevents an abnormal image caused by a burial of a foreign substance in a surface of the charging member 9 from occurring even when the foreign substance gets trapped in a minute gap between the image carrier 2Y and the charging member 9.

In the present invention, the polyether polyol resin is preferably contained at 30-60 wt % with respect to all resins forming the intermediate layer 902. Thus, in a case where the polyether polyol resin is contained at 30-60 wt % with respect to all resins forming the intermediate layer 902, it is possible to further realize a low electrical resistance of the charging member 9. Therefore, even when the minute gap G between the image carrier 2Y and the charging member 9 is made wider, it is possible to provide a charging member 9 which is more difficult to abnormally discharge.

Additionally, in the present invention, a contained quantity of polyether in the polyether polyol resin is preferably 10-40 wt % in terms of ethylene oxide. Thus, if the contained quantity of polyether in the polyether polyol resin is 10-40 wt % in terms of ethylene oxide, it is possible to further realize a low electrical resistance of the charging member 9. And therefore, even when the minute gap G between the image carrier 2Y and the charging member 9 is made wider, it is possible to provide a charging member 9 which is all the more difficult to abnormally discharge.

The intermediate layer 902 contains organic acid salts of diazabicycloundecene or diazabicyclononene and is hardened in the presence of catalysts made from the organic acid salts. Thus, if the intermediate layer 902 contains organic acid salts of diazabicycloundecene or diazabicyclonone and is hardened in the presence of catalysts made from the organic acid salts, even when a ratio of the polyether is heightened, the hardening reaction becomes heightened. Therefore, it is possible to easily obtain the intermediate layer 902 realizing a low electrical resistance property, and thereby it is possible to provide the charging member 9 which is all the more difficult to abnormally discharge.

Figure 6:
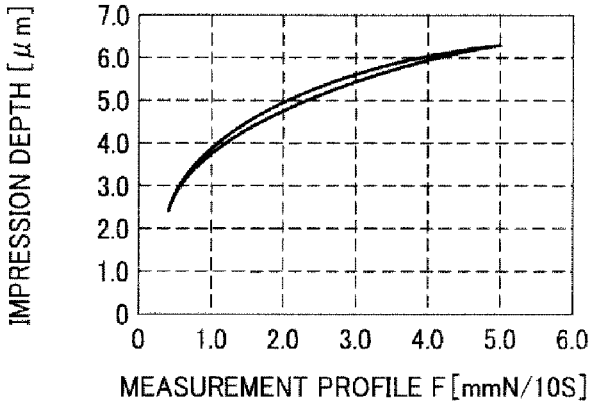
FIG. 6 is a profile of impression depth when a load of 5 mN is applied continuously for 10 seconds to a Vickers square-based pyramid diamond indenter with an apical angle of 136°.

In the present invention, a maximum impression depth ($H_{max}$) of the surface layer 901 is less than or equal to 3 μm. If the maximum impression depth ($H_{max}$) of the surface layer 901 exceeds 3 μm, a foreign substance is easily buried. Accordingly, in the present invention, the maximum impression depth ($H_{max}$) of the surface layer 901 is set to be less than or equal to 3 μm. The hardness of the surface layer 901 is defined by the maximum impression depth ($H_{max}$) of the surface layer 901. The maximum impression depth ($H_{max}$) is measured by a microhardness measurement instrument (Fischerscope H100, manufactured by Fischer Instruments K.K.). FIG. 6 illustrates a profile of impression depth under the load where 5 mN is applied continuously for 10 seconds to a Vickers square-based pyramid diamond indenter with an apical angle of 136°. Universal hardness is defined by a quotient of a loaded test force and a surface area of indentation produced by loading. The surface area of the indentation is calculated by an impression depth impressed by the loaded test force. That is, in a case where the Vickers square-based pyramid diamond indenter is used, the universal hardness is defined by a following formula: universal hardness [HM] =loaded test force [N]/surface area of the Vickers square-based pyramid diamond indenter in the loaded test force [$mm^2$]=F/26.43 $h^2$ Incidentally, conditions of the measurement are as follows: impression amount: 5 mmN/10 sec. impression time: 10 sec., creep: 2 sec., and locations of the measurement: 5 in an axis direction (5 locations at 4 mm-intervals from a center part of the roller).

Thus, in a case where the maximum impression depth ($H_{max}$) of the surface layer 901 is less than or equal to 3 μm, it is possible to reduce a foreign substance adherence to the surface of the charging member 9 and prevent the foreign substance from getting trapped in a gap between the image carrier 2Y and the charging member 9, so that an abnormal image occurrence can be prevented.

Figure 5:
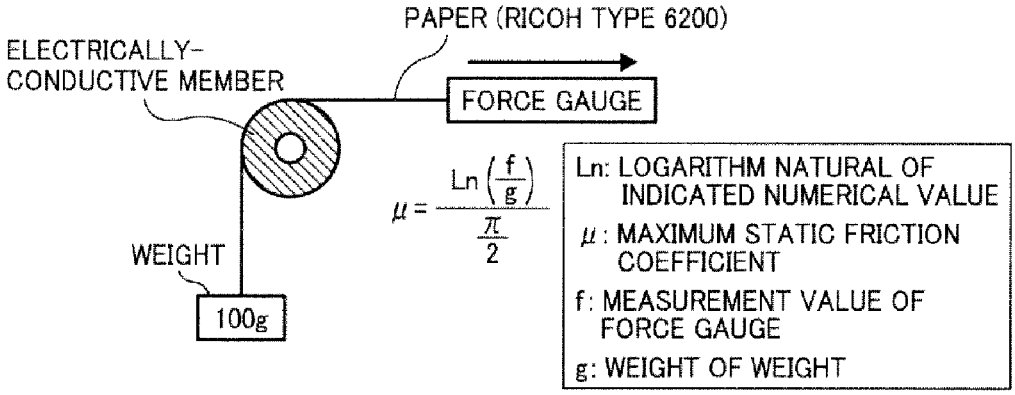
FIG. 5 is an explanatory diagram explaining a method based on Euler's study of a belt.

In the present invention, a maximum static friction coefficient of the surface layer 901 is less than or equal to 0.5. In a case where the maximum static friction coefficient of the surface layer 901 exceeds 0.5, the more foreign substances adhere. Accordingly, the maximum static friction coefficient of the surface layer 901 is set to be 0.5. The maximum static friction coefficient is measured by the following method. The maximum static friction coefficient is measured by use of a method based on Euler's study of a belt illustrated in FIG. 5. The method based on Euler's study of a belt is a method such that a certain load is applied to a friction member which is a reference for an object to be measured, and a maximum static friction coefficient is calculated by a maximum load when the friction member starts moving in the case of pulling at a certain speed. In the method based on Euler's study of a belt illustrated in FIG. 5, a rate of pulling is set to be 1 mm/s. Thus, in a case where the maximum static friction coefficient of the surface layer 901 is set to be less than or equal to 0.5, it is possible to reduce a foreign substance adherence to the surface of the charging member 9 and prevent the foreign substance from getting trapped in a gap between the image carrier 2Y and the charging member 9, so that an abnormal image occurrence can be prevented.

In the present invention, a thickness of the surface layer 901 is set to be 5-15 μm. Thus, in a case where the thickness of the surface layer 901 is set to be 5-15 μm, it is possible to prevent a poor electrical charge by insulation and prevent a foreign substance from adhering to the surface of the charging member, so that an abnormal image occurrence is prevented.

In the present invention, at both end parts of the charging member 9, a ring-shaped spacing member 905 which forms a certain minute gap G by contacting the image carrier 2Y is provided. Thus, in a case where a ring-shaped spacing member 905 which forms a certain minute gap G by contacting the image carrier 2Y is provided at both end parts of the charging member 9, it is further difficult for a residual substance such as a residual toner on the surface of the image carrier 2Y to adhere to the charging member 9.

In the present invention, at both end parts of the charging member 9, a ring-shaped spacing member 905 which forms a certain minute gap G by contacting the image carrier 2Y is provided. Thus, in a case where a ring-shaped spacing member 905 which forms a certain minute gap G by contacting the image carrier 2Y is provided at both end parts of the charging member 9, it is further difficult for a residual substance such as a residual toner on the surface of the image carrier 2Y to adhere to the charging member 9.

Next, the charging member (charger roller) 9 comprising the electrical resistance adjustment layer 903, the intermediate layer 902, the surface layer 901, and the spacing member 905 will be explained in detail.

[Regarding the Electrical Resistance Adjustment Layer 903]

The electrical resistance adjustment layer 903 is formed by a thermal plastic resin composition in which a high-molecular ion-conductive material is dispersed. A volume resistivity of the electrical resistance adjustment layer 903 is preferably $10^6$-$10^9$ Ωcm. If the volume resistivity of the electrical resistance adjustment layer 903 exceeds $10^9$ Ωcm, charging capabilities and transfer capabilities become insufficient. In addition, if the volume resistivity of the electrical resistance adjustment layer 902 is lower than $10^6$ Ωcm, leaks are generated due to current constriction in the entire photoreceptor 2Y. The electrical resistance adjustment layer 902 is preferably formed of polypropylene (PP), polymethylmethacrylate (PMMA), polystyrene (PS), and copolymers (AS, ABS) of these, and thermal plastic resins such as polyamide, polycarbonate (PC) and the like. The high-molecular ion-conductive material that enables dispersion of these thermal plastic resins is preferably a high-molecular compound containing a polyether ester amide component. The polyether ester amide is an ion-conductive high-molecular material and is dispersed and immobilized uniformly at the molecular level in a matrix polymer. Therefore, a variability of a resistance value accompanying poor dispersion which is clearly seen in a composition in which an electron-conductive additive such as metal oxide, carbon black or the like is dispersed does not occur. In addition, when a high voltage is applied to the charging member (charger roller) 9, in the case of the electron-conductive additive, a route through which electricity is more likely to flow is formed locally so that leak currents towards the image carrier 2Y are generated and abnormal images, that is, black and white spotty images are generated in the case of the charging member 9. In contrast, polyether ester amide is a high-molecular material so that a bleed out is hardly generated. As for a blending quantity, because the resistance value needs to be set to a desired value, the thermal plastic resin needs to be 20-70 wt % and a high-molecular ion-conductive additive to be 20-80 wt %.

Furthermore, in order to adjust the resistance value, electrolyte (salts) can be possibly added. The salts can be alkaline metal salt of sodium perchlorate, lithium perchlorate and the like, lithium imide salt of lithium his imide, lithium tris methide and the like, and quaternary phosphonium salts of ethyltriphenylphosphonium tetrafluoroborate, tetraphenylphosphonium bromide and the like. A conductive additive can be used singly or blended multiply within a range not damaging physical properties. In order for a conductive material to disperse uniformly at the molecular level in the matrix polymer, a compatibilizer can be suitably used because micro dispersion in a charging material becomes possible if the compatibilizer is added. The compatibilizer can be a compatibilizer having a glycidyl methacrylate group which is a reactive group. Other additives such as an antioxidant and the like can be used within a range not damaging physical properties. A fabricating method of the resin composition is not particularly limited, but easy fabrication is realized by mixing each material for melting and kneading in a twin-shaft kneading machine, a kneader or the like. In addition, formation of the electrical resistance adjustment layer 903 on the electrically-conductive support (core bar) 904 can be realized easily if the electrically-conductive support 904 is covered by the resin composition using extrusion molding, injection molding or the like.

When the charging member 9 is made by formation of only the electrical resistance adjustment layer 903 on the electrically-conductive support 904, there are cases where performance of the charging member 9 is lowered by the toners and additives of the toners adhering to the electrical resistance adjustment layer 903. Such defects can be prevented by forming the surface layer 901 on the electrical resistance adjustment layer 903. In addition, in the case a contact technique is employed, the charging member 9 needs to be an elastic body. In that case, an elastic electrical resistance adjustment layer 903 can be formed by adding various kinds of conductive additives to rubber materials such as silicone, NBR (nitrile rubber), epichlorohydrin, EPDM and the like. Conventionally used methods can be used for processing methods of the rubber materials.

[Regarding the Intermediate Layer 902]

Figure 9:
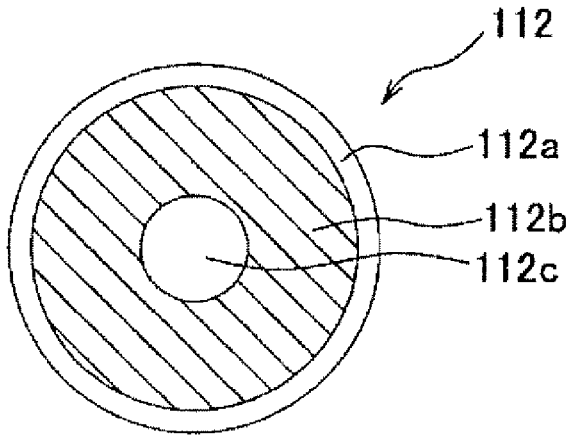
FIG.9 Prior Art
FIG. 9 is a cross-sectional diagram of a conventional charging member (charger roller).

As illustrated in FIG. 9, in the conventional charging member 112, the electrical resistance adjustment layer 112*b* is formed by a molding method, and therefore un evenness of the electrical resistance occurs by an unevenness of stress when performing the molding process, so that there is a problem among products such that there is a product in which a charging unevenness occurs. Consequently, inventors of the present invention, in order to decrease the unevenness of the electrical resistance, found that in a case where the intermediate layer 902 formed of at least (a) a polyol resin in which fluorine or silicon is grafted; (b) a polyether polyol resin; (c) fluorine-containing organic anion salts containing alkali metal or alkali earth metal; and (d) polyisocyanate, is provided, the unevenness of the electrical resistance can be decreased.

In the intermediate layer 902 of the present invention, materials forming the intermediate layer 902 are dissolved in an organic solvent and thereby a coating material is made. The coating material is coated on the surface of the electrical resistance layer 903 by various kinds of coating methods such as spray coating, dipping, roll coating, and the like, and the intermediate layer 902 is formed. The thickness of the intermediate layer 902 is preferably 10-50 μm. As materials forming the intermediate layer 902, polyether polyol resin is necessary to be ion-conductive, however it may be mixed with aother binder resin from the viewpoint of forming a layer and so on. The polyether polyol resin is selected from polyethylene oxide, polypropylene oxide, polyethylene oxide-polypropylene oxide copolymer, and polyethylene-graft-PEG-copolymer. A contained quantity of these polyether polyol resins is preferably 20-70 wt %, and is more preferably 30-60 wt % of entire resin forming the intermediate layer (coating film) 902. A quantity of polyether in polyether polyol is preferably 5-55 wt %, and is more preferably 10-50 wt %, in terms of ethylene oxide.

A one-component coating material and a two-component coating material are usable as the material forming the intermediate layer 902, and it is possible to further enhance a durability (mechanical property value) of a coating film by using a two-component coating material together with a hardener. In the case of a two-component coating material, it is general to use a method such that resins are cross-linked and hardened by heating a coating film. However, because the electrical resistance adjustment layer 903 is formed of thermoplastic resin, heating at a high temperature is not possible. Therefore, as a two-component coating material, it is effective to use a base resin having a hydroxyl group in the molecule and an isocyanate-based resin that develops a cross-linking reaction with the hydroxyl group. The isocyanate-based resins can be a polyisocyanate resin and specifically, 2,4-trilene diisocyanate, diphenylmethane-4,4'-diisocyanate, xylylene diisocyanate, isophorone diisocyanate, lysine methyl ester diisocyanate, methyl cyclohexyl diisocyanate, trimethyl hexamethylene diisocyanate, hexamethylene diisocyanate, n-pentane-1,4-diisocyanate as well as trimers of these, adducts and biurets of these, polymers of these having equal to or more than two isocyanate groups, and furthermore, blocked isocyanates or the like. But the isocyanate based resins are not limited to these above. By using isocyanate-based resins, cross-linking and hardening reactions occur at a comparatively low temperature below 100° C. A mixing quantity of the hardener is 0.1-5 equivalent weight with respect to 1 equivalent weight of the functional group (—OH group) and preferably 0.5-1.5 equivalent weight. In addition, a hardener of amino resins which are melamine and guanamine resin and the like can be suitably used in accordance with heat resistance properties of the base material.

In order to be ion-conductive, as electrical conductivity-imparting materials (electrolyte salt), alkaline metal salt of perchloric acid such as sodium perchlorate, lithium perchlorate and the like, or alkaline earth metal salt, fluorine organic anion salts such as lithium bis(trifluoromethanesulfonyl) imide, lithium tris(trifluoromethanesulfonyl)methane, lithium trifluoromethanesulfonate, lithium trismethide, ethyltriphenylphosphonium tetrafluoroborate, tetraphenylphosphonium bromide and the like, and organic ion-conductive materials such as modified fatty acid dimethyl ammonium ethosulphate, stearic ammonium acetate, lauryl ammonium acetate and the like can be used. The present inventors found that the coating film (the intermediate layer) can have low electrical resistance property if among the above materials, lithium bis(trifluoromethanesulfonyl)imide, lithium tris(trifluoromethanesulfonyl)methane or lithium trifluoromethanesulfonate is used. An additive quantity of the electrolyte salt is preferably 1-15 wt %, and is more preferably 1.5-10 wt % of entire resins forming the coating film (the intermediate layer). A conductive additive can be used singly or blended multiply within a range not damaging physical properties.

[Regarding a Method for Quantitative Determination of Ethylene Oxide]

A 1H-spectrum measurement of polyether polyol is performed by a NMR (nuclear magnetic resonance) spectroscopy, and it is found to be polyether polyol of propylene oxide and ethylene oxide by the presence of $CH_3$ (around 1.14 ppm), $CH_2$ (around 3.41 ppm), methine hydrogen, $CH_2$'—(around 3.54 ppm) of polypylene oxide, and $CH_2$ (around 3.66 ppm) of ethylene oxide. A content rate of ethylene oxide is obtained by peak area ratios of around 1.14, 3.54, and 3.66 ppm of NMR spectrum. A peak area is calculated by dividing a peak vertically.

[Regarding the Surface Layer 901]

The surface layer 901 is formed of a material containing a fluorine-based resin, a silicone-based resin, a polyamide resin, a polyester resin or a urethane resin. There materials are nonviscous, therefore they are suitable for the material forming the surface layer 901. In particular, a material containing a fluorine-based resin or a silicone-based resin is low in friction coefficient, therefore it is preferable for preventing toners and foreign substances from adhering. In order to form the surface layer 901 on the intermediate layer 902, firstly a material forming the surface layer 901 is dissolved in organic solvent and a coating material is prepared. And the coating material forms the surface layer 901 by spray coating, dipping, roll coating and so on. The surface layer 901 is preferable not electrically-conductive. In the case of being electrically-conductive, an electron-conductive additive such as a carbon black can not be used for the surface layer 901 because an abnormal electrical discharge occurs by a local leak. In addition, in the case of being ion-conductive, the surface layer 901 has a lower hardness and an adhesiveness of the surface layer 901 is increased, and thereby it is difficult to achieve the object of the present invention to prevent an occurrence of an abnormal image due to a burial of a foreign substance onto the surface of a charging member even when the foreign substance is interposed in a minute gap between an image carrier and the charging member. Therefore, in the present invention, the surface layer 901 is insulative. The thickness of the surface layer 901 of the present invention is preferably less than or equal to 15 μm, and is more preferable less than or equal to 5-15 μm. If the thickness of the surface layer 901 is more than 15 μm, a performance as a charging member is lowered and a charge potential is lowered. In addition, if the thickness of the surface layer 901 is thinner than 5 μm, an effect obtained by the surface layer having a higher hardness can not be obtained.

One-component and two-component materials are usable as materials forming the surface layer 901 as well as the intermediate layer 902. In particular, a two-component coating material used together with a hardener can enhance characteristics of an environment resistance, a non-adhesiveness, a mold-releasability and so on. A two-component coating material of a material forming the surface layer 901 cross-links and hardens a contained resin by heating a coated coating film. However, it is not possible to heat the electrical resistance adjustment layer 903 which is provided inside the surface layer 901 at high temperature, because the electrical adjustment layer 903 is formed of a thermoplastic resin.

As a two-component coating material, it is effective to use a base resin having a hydroxyl group in the molecule and an isocyanate-based resin that develops a cross-linking reaction with the hydroxyl group. The isocyanate-based resin can be a polyisocyanate resin and specifically, 2,4-trilene diisocyanate, diphenylmethane-4,4'-diisocyanate, xylylene diisocyanate, isophorone diisocyanate, lysine methyl ester diisocyanate, methyl cyclohexyl diisocyanate, trimethyl hexamethylene diisocyanate, hexamethylene diisocyanate, n-pentane-1,4-diisocyanate as well as trimer of these, adducts and Biurets of these, polymers of these having equal to or more than two isocyanate groups and furthermore, a blocked isocyanates or the like. But the isocyanate-based resins are not limited to these above. By using isocyanate-based resins, cross-linking and hardening reactions occur at a comparatively low temperature below 100° C. A mixing quantity of the hardener is 0.1-5 equivalent weight with respect to 1 equivalent weight of the functional group (—OH group) and preferably 0.5-1.5 equivalent weight. In addition, a hardener of amino resins which are melamine and guanamine resin and the like can be suitably used in accordance with heat resistance properties of the base material. In order for the surface layer 901 to be nonadhesive with respect to toners, it is easy to process a material containing a resin in which silicone or fluorine is grafted in the molecule.

[Regarding the Spacing Member 905]

A necessary characteristic of the spacing member 905 is to form it with stability in the minute gap G between the charging member 9 and a photoreceptor 2Y regardless of a long time and an environment. Therefore, a material with small hygroscopic property and wear resistance is desired. In addition, it is also important that toners and a toner additive become difficult to adhere to the spacing member 905. Besides, because the spacing member 905 comes into sliding contact with the photoreceptor 2Y, it is also important for the photoreceptor 2Y not to be worn. Consequently, the material for the spacing member 905 should be appropriately selected according to various conditions. The material forming the spacing member 905 can specifically be general-purpose resins such as polyethylene (PE), polypropylene (PP), polyoxymethylene (POM: polyoxymethylene), polymethylmethacrylate (PMMA), polystyrene (PS) and copolymers (AS: acrylonitrile styrene, ABS: acrylonitrile butadiene styrene) of these as well as polycarbonate (PC), urethane, fluorine (PTFE: polytetrafluoroethylene) or the like. In particular, in order to fix the spacing member 905 reliably, an adhesive can be applied for adhesion. In addition, an insulating material is preferable for the spacing member 905. Specifically, an insulating material with a volume resistivity greater than or equal to $10^{-13}$ Ωcm is preferable. Insulation properties are necessary because generations of leakage currents with the photoreceptor 2Y need to be eliminated. The spacing member 905 is formed by a molding process.

A part of the spacing member 905 has differences in height to the electrical resistance adjustment layer 903. As a method to form the minute gap G, the electrical resistance adjustment layer 903 and the spacing member 905 can be simultaneously worked by a removal process of cutting, grinding or the like. If the electrical resistance adjustment layer 903 and the spacing member 905 are simultaneously worked, then the minute gap G can be formed with high precision. A height of a part of the spacing member 905 adjacent to the electrical resistance adjustment layer 903 can be the same as a height of the electrical resistance adjustment layer 903 or made lower than the height of the electrical resistance adjustment layer 903. As a result, a contact width between the spacing member 905 and the photoreceptor 2Y is reduced so that the minute gap G between the charging member 9 and the photoreceptor 2Y can have a high precision. Thus, an external surface of a side end part of the spacing member 905 of the electrical resistance adjustment layer 903 side can avoid coming into contact with the image carrier 2Y. Therefore, leaked currents generated if the electrical resistance adjustment layer 903 adjacent via the side end part contacts the image carrier 2Y can possibly be prevented. In addition, by applying work that lowers the end part of the spacing member 905 of the electrical resistance adjustment layer 903 side, the end part can be set as a clearance (clearance processing) of a cutting blade or the like when performing the removal process. In addition, a shape of the clearance (clearance processing) can be any shape as long as the shape is such that the external surface of the end part of the spacing member 905 does not come into contact with the image carrier 2Y. Furthermore, control difficulties arise in consideration of a variability, if a masking when coating the surface layer 901 is performed at a boundary between the electrical resistance adjustment layer 903 and the spacing member 905. Therefore, when a level difference is formed, the surface layer 901 should be formed until the surface layer reaches the spacing member 905. The spacing member 905 is formed to be lower than or with a same height as the electrical resistance adjustment layer 903. Thereby the surface layer 901 can be formed reliably on the electrical resistance adjustment layer 903.

Next, the charging device 90 of the present invention will be explained in detail.

Figure 4:
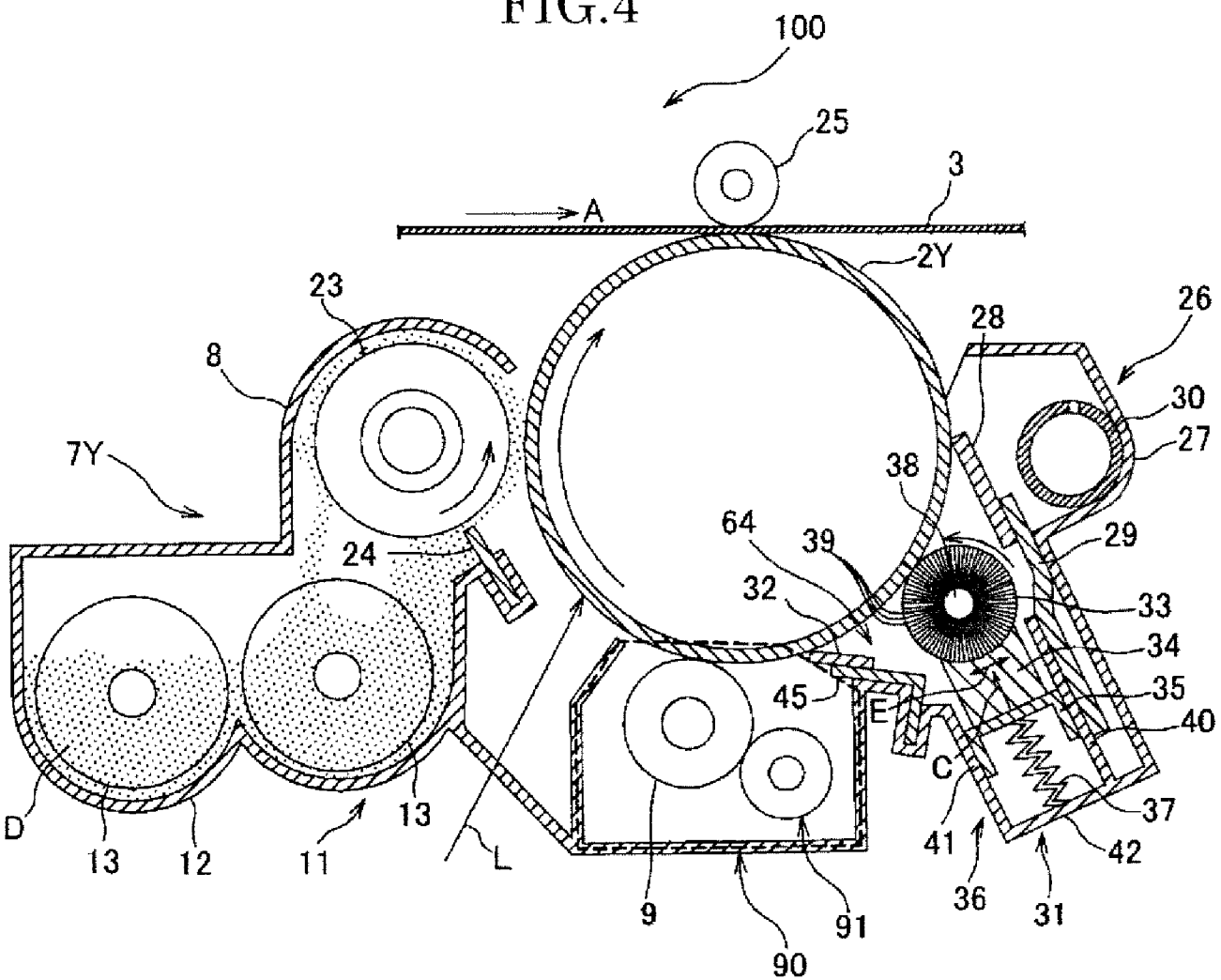
FIG. 4 is a schematic explanatory diagram illustrating a configuration of an image forming part in the image forming apparatus according to an embodiment of the present invention.

The charging device 90 of the present invention is a part encircled by a dotted line of FIG. 4. A solid lubricant decomposes by electrical discharges to obtain decomposition products. A cleaning member 91 for removing the decomposition products or toners attached onto the surface of the charging member 9 is disposed on the charging device 90. In the charging device 90, the cleaning member 91 is formed of melamine foam. The melamine foam is open-cell foam. The cleaning member 91 comes into contact with the surface of the charging member 9 and is rotated by a rotation of the charging member 9. The cleaning member 91 can be directly driven via a gear or the like. But it is preferable from a cleaning viewpoint that the cleaning member 91 have the same speed as an angular speed of the charging member 9.

The charging device 90 includes a power source (not illustrated) that applies voltage to the charging member 9. For the voltage, a case with only DC voltage is fine but DC voltage and AC voltage are preferably superimposed. In particular, in the case of the non-contact type, electrification irregularities become easily generated due to changes of the minute gap G between the image carrier (photoreceptor) 2Y and the charging member (charger roller) 9 so that when only DC voltage is applied, there are cases in which surface electrical potentials of the image carrier 2Y become nonuniform. By using a voltage in which AC voltage is superimposed, the surface of the charger roller 9 becomes equipotential so that electrical discharges become stable and the image carrier 2Y can be charged uniformly. Regarding AC voltage in the superimposed voltage, it is preferable that voltage between peaks are preferably equal to or more than two times of a voltage at the start of charging of the image carrier 2Y. The voltage at the start of charging is an absolute value of a voltage of when the image carrier 2Y begins to be charged in the case only direct current is applied to the charger roller 9. Thus, the electrical charge is moved from the image carrier 2Y to the charger roller 9, and as a result, the image carrier 2Y can be charged uniformly in a more stable state. In addition, a frequency of the AC voltage is desirably equal to or more than 7 times of a circumferential velocity (process speed) of the image carrier 2Y. By setting the frequency to be equal to or more than 7 times, a moiré image is no longer recognizable by eye.

Figure 2:
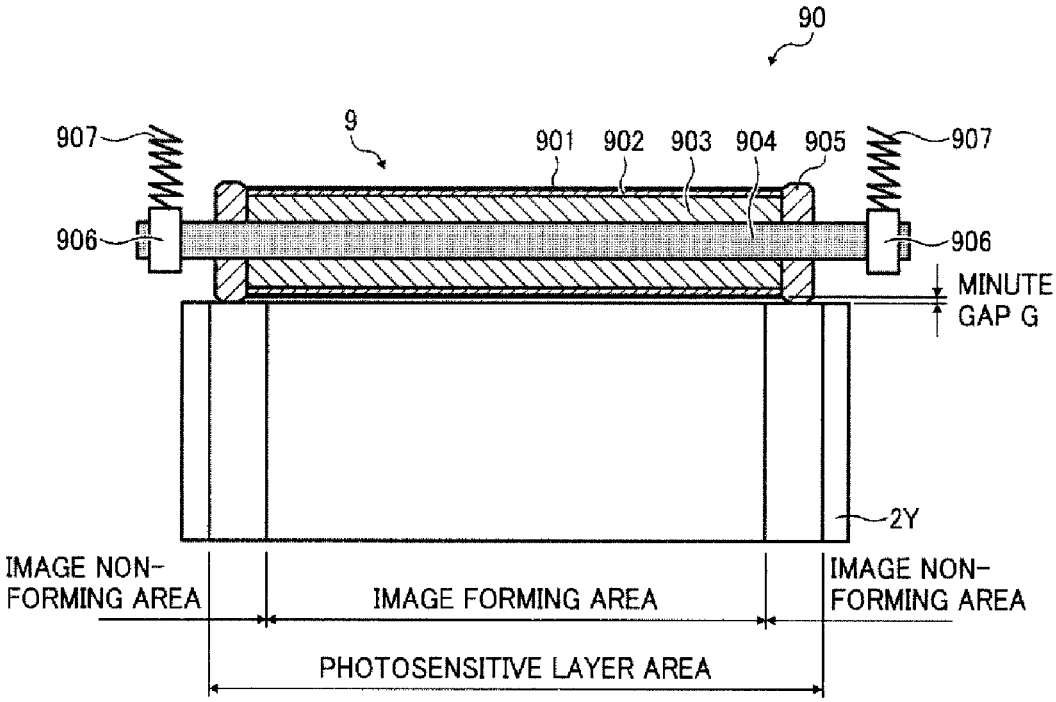
FIG. 2 is a schematic diagram illustrating a state of a charging member (charger roller) when located on an image carrier according to an embodiment of the present invention.

As illustrated in FIG. 2, the charging device 90 of the present invention includes a cylindrical shaped charging member 9 disposed opposed to the photoreceptor drum 2Y and a cylindrical shaped charged cleaning member 91 disposed to come into contact with a surface situated at a reverse side to a surface in which the charging member opposes the photoreceptor drum 2Y. In addition, both end parts of the charging member 9 are respectively urged towards the side of the photoreceptor drum 2Y by the compression spring 907 which is the pressure applier. The charging member 9 is connected to a power source (not illustrated) and a predetermined voltage is applied. As for the voltage, it is fine when only the DC voltage is used, but preferably DC voltage should be superimposed on AC voltage. By applying the AC voltage, the surface of the photoreceptor drum 2Y can be electrically charged more uniformly. The charging member 9 can be disposed to be in contact with the photoreceptor drum 2Y. But in the present embodiment, the charging member 9 is disposed with a minute gap G with respect to the photoreceptor drum 2Y. The minute gap G can be set by providing a spacing member 905 having a certain thickness in an image non-forming area of the both end parts of the charging member 9 so that a surface of the spacing member 905 comes into contact with a surface of the photoreceptor drum 2Y.

The minute gap G between the charging member 9 and the photoreceptor drum 2Y is limited to less than or equal to 100 μm and preferably in a range of about 5-70 μm from the spacing member 905. In such a way, formation of abnormal images during operation of the charging device 90 can be suppressed. In order to charge the photoreceptor drum 2Y to a predetermined charge quantity, a great amount of discharge products by the electrical discharge becomes necessary. However, if the minute gap G is equal to or more than 100 μm, a distance of electrons emitted from the charging member 9 reaching the photoreceptor drum 2Y becomes longer and a breakdown voltage of the electrical discharge based on Paschen's Law becomes large. Therefore, an applied voltage to the charging member 9 and the photoreceptor drum 2Y needs to be higher. In addition, if the gap G (that is, a discharge space) between the charging member 9 and the photoreceptor drum 2Y becomes large, a great amount of redundantly generated discharge products remains in the gap after image formation and adheres to the photoreceptor drum 2Y, and cause deteriorations over time of the photoreceptor drum 2Y. On the other hand, if the gap G becomes small, the distance of electrons emitted from the charging member 9 reaching the photoreceptor drum 2Y becomes shorter, and this makes it possible to charge the photoreceptor drum 2Y even if the applied voltage to the charging member 9 and the photoreceptor drum 2Y is small. However, the minute gap G formed by the charging member 9 and the photoreceptor drum 2Y becomes narrower and air flow becomes worse. Therefore, because the redundantly generated discharge products in the gap remains in the gap, in the same way as the above-described case in which the gap G is large, a large amount of the discharge products remains in the gap and adheres to the photoreceptor drum 2Y even after image formation. The discharge products cause deteriorations over time of the photoreceptor drum 2Y. Consequently, the applied voltage should be made smaller and few discharge products should be generated, and the discharge space should be preferably formed to an extent in which air does not remain. Accordingly, the minute gap G is limited to less than or equal to 100 μm and preferably in a range of about 5-70 μm. Hence generations of streamer electrical discharges can be prevented and few discharge products are generated. As a result, an amount of the discharge products accumulated on the photoreceptor drum 2Y is lessened so that spotty shaped image spots and image deletions can be prevented.

Here, as illustrated in FIG. 4, residual toners on the photoreceptor drum 2Y after image development are cleaned by a cleaning device 64 disposed opposed to the photoreceptor drum 2Y. But complete removal is difficult. Therefore, negligible toners pass through the cleaning device 64 and are carried to the charging device 90. At this moment, if a particle diameter of the toners is larger than the minute gap G, the toners are in slide abrasion with the photoreceptor drum 2Y and the charging member 9 and are heated. The toners are then possibly fusion bonded to the charging member 9. Abnormal discharges occur in a part fusion bonded with the toners because the part is situated closer to the photoreceptor drum 2Y and electrical discharges are generated preferentially. Consequently, the minute gap G is preferably larger than a maximum particle diameter of the toners used for an image forming apparatus 1.

In addition, the charging member 9 is fitted into a shaft bearing 906 disposed on a side plate of a not illustrated housing. The shaft bearing 906 is not driven and is formed by a resin with a low friction coefficient. The compression spring 907 is disposed on the shaft bearing. The charging member 9 is pressed by the compression spring 907 towards a surface direction of the photoreceptor drum. In such a way, a certain minute gap G can be formed even with mechanical oscillations and deflections of the core bar 904. The pressed load is preferably 4-25 N and further preferably 6-15 N. Even if the charging member 9 is fixed by the shaft bearing 906, due to an asperity of the surface of the charging member as well as oscillations during operations, the size of the minute gap G fluctuates. Therefore, there are cases in which the minute gap G deviates from the appropriate range which causes the deteriorations of the photoreceptor drum 2Y over time. Here, the load means all loads applied to the photoreceptor drum 2Y through the spacing member 905. The load can be adjusted by a force of the compression spring 907 disposed at both ends of the charging member 9, own weights of the charging member 9 and the cleaning member 91, and the like. Fluctuations are generated due to rotating of the charging member 9 and jump ups are generated by an impact strength of a drive gear or the like. If the load is too small, both the fluctuations of the minute gap G and the jump ups can not be suppressed. If the load is too large, frictions between the charging member 9 and the shaft bearing 906 to which the charging member 9 is fitted become large so that a quantity of wear becomes large and fluctuations of the minute gap G occur over time. Consequently, the load should preferably be in the range of 4-25 N and further preferably 6-15 N. In such a way, the minute gap G can be set to an appropriate range and the generation of the discharge products can be lessened so that the quantity of adherents accumulated on the photoreceptor drum 2Y can be lessened and operating life of the photoreceptor drum 2Y can be extended. In addition, spot shaped abnormal images and image flows can be prevented.

The charging member 9 is cylindrically shaped. A pair of gears is disposed in both end parts of the charging member 9. The charging member 9 is rotatably supported via these gears. Alternatively, both ends of the charging member 9 are rotatably supported by the shaft bearing 906. As described above, the charging member 9 is cylindrically shaped. Therefore, a surface of the charging member 9 is actually a curved surface that becomes gradually further away from a nearest adjacent part of the photoreceptor drum (image carrier) 2Y. Consequently, the image carrier 2Y can be further uniformly charged. If a part of the charging member 9 facing the image carrier 2Y is sharp pointed, an electrical potential in the vicinity of the part becomes high and electrical discharges begin from there so that non-uniform discharges are generated. As a result, it becomes difficult to uniformly charge the surface of the image carrier 2Y. Therefore, because the charging member 9 is cylindrical shaped, the image carrier 2Y can be charged uniformly. In addition, a surface in which electrical discharges are generated suffers severe stress, and generally, a surface part of the charging member 9 in which electrical discharges are generated has an increased deterioration speed in comparison to other parts in which electrical discharges are not generated. Therefore, if electrical discharges are always generated at the same part of the charging member 9, deteriorations at the part further progress. If the discharge at the part further continues, the part can be scraped off. Therefore, by rotating the charging member 9, an entire side surface of the charging member can be used as the discharge surface. As a result, early deteriorations of the charging member 9 can be prevented and the charging member 9 can be used over a long time span.

Figure 3:
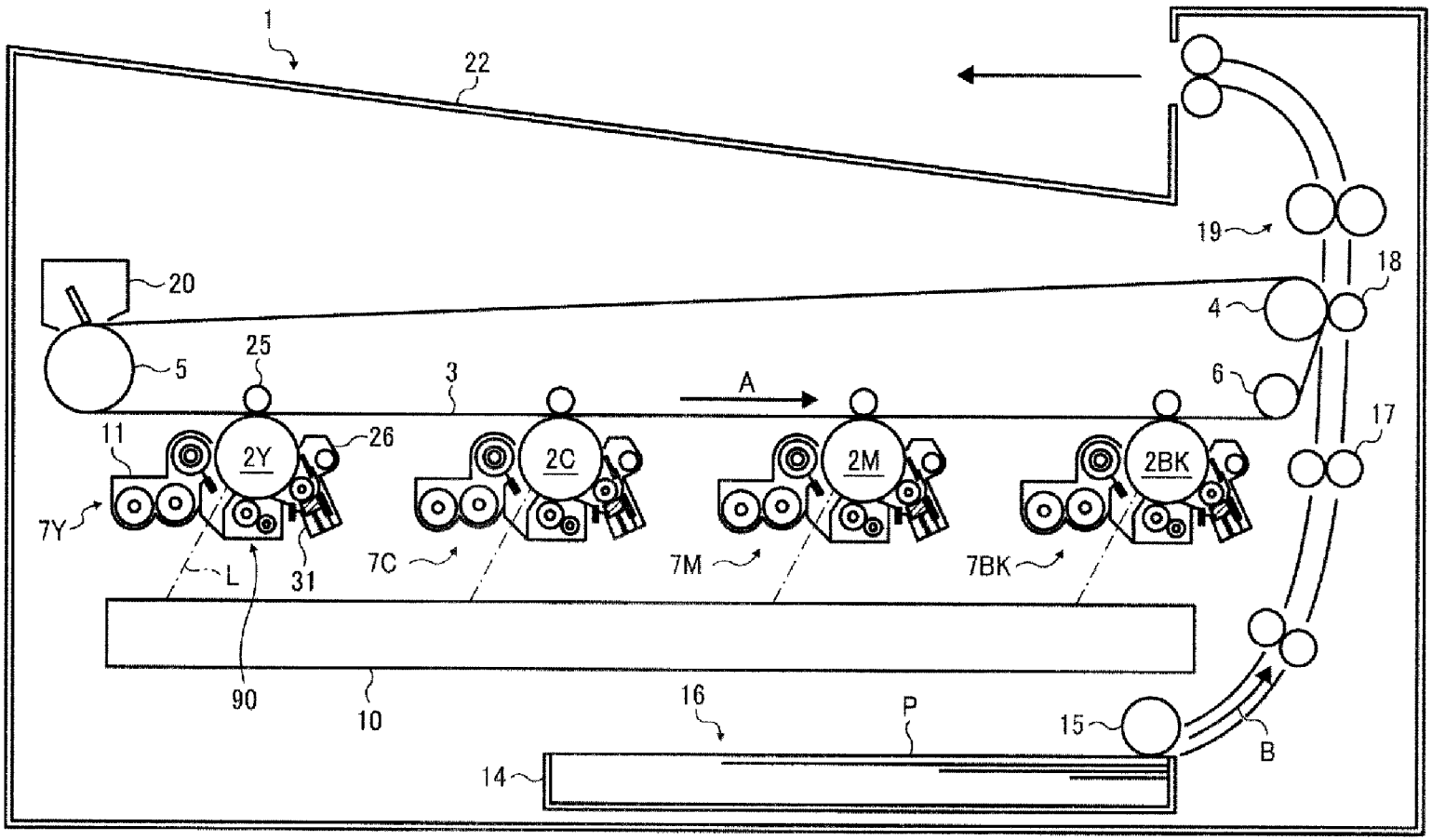
FIG. 3 is a schematic explanatory diagram of an image forming apparatus according to an embodiment of the present invention.

As illustrated in FIG. 3 and FIG. 4, in a process cartridge 7Y of the present invention, the image carrier 2Y and the charging device 90 are supported integrally and, the process cartridge 7Y is fixed to a main body of an image forming apparatus 100 to be freely detachable. Then in the process cartridge, the charging device 90 is constituted from the charging device described in the present invention. In such a way, the image carrier 2Y and the charging device 90 are supported integrally and the process cartridge 7Y is fixed to the main body of the image forming apparatus 100 to be freely detachable. In addition, the charging device 90 is constituted from the charging device described in the present invention. Therefore, even if a foreign substance is interposed in the minute gap G between the image carrier 2Y and the charging member 9, an occurrence of abnormal images by a burial of the foreign substance on the surface of the charging member 9 is prevented. Furthermore, replacement is simplified while the minute gap G between the image carrier 2Y and the charging member 9 is precisely maintained, and user maintenance is possible.

In addition, as illustrated in FIG. 3 and FIG. 4, the image forming apparatus 1 (100) of the present invention includes at least a process cartridge 7Y, an exposure device that forms an electrostatic latent image by performing an exposure on the surface of the image carrier 2Y, an image development device 11 that visualizes the electrostatic latent image on the surface of the image carrier 2Y by supplying toners, and a transfer device (transfer roller 25) that transfers onto a transfer medium (intermediate transfer belt 3) a visualized image on the surface of the image carrier 2Y. In addition, in the image forming apparatus 1 of the present invention, the process cartridge is constituted from a process cartridge described in the present invention. Thus, in a case where the process cartridge 7Y is constituted from the process cartridge described in the present invention, even when a foreign substance is interposed in the minute gap G between the image carrier 2Y and the charging member 9, an occurrence of abnormal images by a burial of the foreign substance on the surface of the charging member 9 is prevented. Furthermore, stable images can be obtained over a long time period.

Next, the image forming apparatus 1 (100) will be described in detail. As illustrated in FIG. 3 and FIG. 4, the image forming apparatus 1 of the present invention includes an intermediate transfer belt 3 with no end rotated and driven in a direction of an arrow A and wrapped around a plurality of supporting rollers 4, 5 and 6. The image forming apparatus 1 also includes first to fourth process cartridges 7Y, 7C, 7M and 7BK disposed to oppose the intermediate transfer belt 3. Each process cartridge 7Y to 7BK includes image carriers 2Y, 2C, 2M and 2BK constituted as drum shaped photoreceptors in which toner images of different colors are formed respectively. Toner images of different colors are respectively formed on each image carrier. Each toner image is superimposed and transferred on the intermediate transfer belt 3. The intermediate transfer belt 3 constitutes an example of a transfer material to which toner images formed on the image carriers 2Y, 2C, 2M and 2BK are transferred. A mechanism of forming toner images on each image carrier 2Y to 2BK of the first to the fourth process cartridges 7Y to 7BK and transferring the toner images onto the intermediate transfer belt 3 is substantially the same except that colors of the toner images are different so that only the mechanism of forming a toner image on the image carrier 2Y of the first process cartridge 7Y and transferring the toner image onto the intermediate transfer belt 3 is described.

FIG. 4 is an enlarged cross-sectional diagram of the first process cartridge 7Y. The image carrier 2Y of the process cartridge 7Y illustrated here is supported by a unit case 8 to be freely rotatable and is rotatably driven in a clockwise direction by a not illustrated driving device. At this moment, charging voltages are applied to a charging roller 9. The charging roller 9 is supported by the unit case 8 to be freely rotatable. In such a way, a surface of the image carrier 2Y is charged with a predetermined polarity. A light-modulated laser beam L emitted from a light writing device 10 illustrated in FIG. 3 separate from the process cartridge 7Y is irradiated onto the charged image carrier. In such a way, an electrostatic latent image is formed on the image carrier 2Y. This electrostatic latent image is visualized by an image development device 11 as a yellow toner image.

The image development device 11 includes an image development case 12 constituted by a part of the unit case 8. A two-component system dry type developer D having a toner and a carrier is stored in the image development case 12. In addition, two screws 13 and 13 that stir the developer D are disposed in the image development case 12. In addition, an image development roller 23 rotated and driven in a counter-clockwise direction in the FIG. 4 is also disposed in the image development case 12. The developer drawn up to a circumferential surface of the image development roller 23 is supported by the circumferential surface of the image development roller 23 and carried over in a rotating direction of the image development roller 23. The developer having passed through a doctor blade 24 is carried over to an image development area between the image development roller 23 and the image carrier 2Y. At this moment, toners in the developer are transited in an electrostatic manner onto the electrostatic latent image formed on the image carrier 2Y. The latent image is visualized as a toner image. The developer having passed through the image development area is separated from the image development roller 23 and stirred by the screws 13 and 13. In such a way, the toner image is formed on the image carrier 2Y. In addition, an image development device using a one-component system developer without a carrier can also be adopted.

On the other hand, with the intermediate transfer belt 3 situated in between, a transfer roller 25 of a first order transfer is disposed at a side opposite to the process cartridge 7Y. When a transfer voltage is applied to the transfer roller 25 of the first order transfer, a toner image on the image carrier 2Y is transferred by a first order transfer onto the intermediate transfer belt 3 rotated and driven in the direction of the arrow A. After toner image transfer, transferred residual toners adhering to the image carrier 2Y are removed by a cleaning device 26. The cleaning device 26 of the present example includes a cleaning case 27 constituted from a part of the unit case 8, a cleaning blade 28 with its tip edge part pressure-contacting the image carrier 2Y, a blade holder 29 that holds the cleaning blade 28 and a screw 30 for carrying toners disposed in the cleaning case 27. The cleaning blade 28 is disposed in a direction counter to a moving direction of the surface of the image carrier 2Y. The cleaning blade 28 is formed of elastic bodies of rubber or the like. A base end side of the cleaning blade 28 is fixed to the blade holder 29 for example by an adhesive. Because the tip edge part of the cleaning blade 28 is pressure-contacted to the surface of the image carrier 2Y in such a way, transferred residual toners on the image carrier 2Y can be scraped off and removed. The removed toner is carried outward of the cleaning case by a screw 30. The screw 30 is rotated and driven to carry toners. In such a way, the cleaning blade 28 functions to clean the image carrier 2Y after the toner image is transferred onto a transfer material, that is, the intermediate transfer belt 3 in the example of FIG. 2.

In addition, the process cartridge 7Y includes a lubricant application device 31 that applies a lubricant to the image carrier 2Y and a blade 32 that functions to even out the lubricant applied to the image carrier 2Y. However, these are described in detail later.

In the same way as the above described image carrier 2Y, a Cyan toner image, a Magenta toner image and a Black toner image are respectively formed on the second to the fourth image carriers 2C, 2M and 2BK illustrated in FIG. 3. These toner images are sequentially superimposed on the intermediate transfer belt 3 to be transferred by the first order transfer. The intermediate transfer belt 3 is already transferred with a Yellow toner image so that a composite toner image is formed on the intermediate transfer belt 3. The fact that after the toner image transfer, transferred residual toners on each image carrier 2C, 2M and 2BK are removed by the cleaning device is no different from the case of the first image carrier 2Y.

On the other hand, as illustrated in FIG. 3, a paper feeding device 16 having a paper feeding cassette 14 holding a recording medium P which is for example constituted from transfer paper and a paper feeding roller 5 is disposed at a lower part within a main body of the image forming apparatus 1. An uppermost recording medium P is fed out in a direction of an arrow B by rotations of the paper feeding roller 15. The fed out recording medium is fed by a pair of registration rollers 17 into a gap between a part of the intermediate transfer belt 3 wrapped around the supporting roller 4 and a transfer roller 18 of a second order transfer disposed opposite to the part at a predetermined timing. At this moment, a predetermined transfer voltage is applied to the transfer roller 18 of the second order transfer so that a composite toner image on the intermediate transfer belt 3 is transferred by the second order transfer onto the recording medium P. The recording medium P transferred with the composite toner image by the second order transfer is carried further upwardly to pass through a fusing device 19. At this moment, the toner image on the recording medium P is fused by influences of heat and pressure. The recording medium P having passed through the fusing device 19 is discharged to a paper discharge part 22 situated at an upper part of the image forming apparatus 1. In addition, after toner image transfer, transferred residual toners adhering onto the intermediate transfer belt 3 are removed by a cleaning device 20.

In order to suppress wear of the cleaning blade 28 and the image carrier 2Y illustrated in FIG. 4 and to maintain a high cleaning performance by the cleaning blade 28 even when spherical toners of a small particle diameter are used, the above-described lubricant application device 31 is disposed in the image forming apparatus of the present example. The above-described lubricant application device 31 is also disposed in the second to the fourth process cartridges 7C, 7M and 7BK. However, because their constitutions and operations are the same, here only the lubricant application device 31 of the process cartridge 7Y illustrated in FIG. 4 is described.

The lubricant application device 31 illustrated in FIG. 4 includes a brush roller 33 that comes into contact with the surface of the image carrier 2Y, a solid lubricant 34 disposed opposite to the brush roller 33, a lubricant holder 35 that fixedly supports the solid lubricant 34, a guide 36 that guides the solid lubricant 34 via the lubricant holder 35 and a compression coil spring 37 which is an example of a pressing device. The brush roller 33 includes a core shaft 38 and a great amount of brush fibers 39 with their base end parts fixed to the core shaft 38. The brush roller 33 is approximately parallel to the image carrier 2Y and is long extended along the image carrier 2Y. Each end part of a longitudinal direction of the core shaft 38 of the brush roller 33 is supported via not illustrated shaft bearings to be freely rotatable with respect to the unit case 8. During image forming operations, the brush roller 33 is rotated and driven in a counterclockwise direction in FIG. 3. In addition, the solid lubricant 34 is formed to be parallel to the brush roller 33 with a long extended rectangular solid shape. A tip end surface of the solid lubricant 34 at a side facing the brush roller 33 comes into contact with the brush fibers 39 of the brush roller 33. A surface at a base end side of the solid lubricant 34 opposite to the above-described tip end surface is fixed to the lubricant holder 35. The guide 36 of the present example includes a pair of guide plates 40 and 41 disposed parallel and opposite to each other with an interval. These guide plates 40 and 41 are integrated by a connecting plate 42. The pair of guide plates 40 and 41 as well as the connecting plate 42 are constituted by a part of the unit case 8. The lubricant holder 35 is disposed between the pair of guide plates 40 and 41. The lubricant holder 35 comes into contact with the pair of mutually facing surfaces of guide plates 40 and 41 to slide along thereof. A method of pressing the lubricant to the brush roller can be achieved by a spring or the like in which the spring presses the solid lubricant 34 with respect to the brush roller 33 via the lubricant holder 35. In FIG. 4, this pressing direction is illustrated by an arrow C. In addition, instead of the compression coil spring, a pressing device constituted from a torsion coil spring, a plate spring or the like can be used.

As described above, the sold lubricant 34 is pressure-contacted to the brush fibers 39 of the brush roller 33. Besides, the brush fibers 39 are pressure-contacted to the surface of the image carrier 2Y. At the moment, because the brush roller 33 rotates, lubricant of the solid lubricant 34 is shaved off by the brush fibers 39 so that the powder shaped shaved off lubricant is applied to the surface of the image carrier 2Y. Thus, the brush roller 33 constitutes an example of a lubricant supply member that supplies to the surface of the image carrier the powder shaped lubricant shaved off from the solid lubricant 34. The solid lubricant 34 is shaved off by the brush roller 33 and consumed. Therefore, a thickness of the solid lubricant 34 decreases over time but since the solid lubricant 34 is pressed by the compression coil spring 37, the solid lubricant 34 always comes into contact with the brush fibers 39 of the brush roller 33.

Because the lubricant is applied to the surface of the image carrier 2Y, frictional coefficient of the image carrier surface can be suppressed to be low. For this reason, wears of the image carrier 2Y and the cleaning blade 28 can be suppressed and their operating lives can be extended. In addition, even when spherical toners of a small particle diameter are used, large decreases in a cleaning performance of the image carrier 2Y due to the cleaning blade 28 can be prevented. In addition, the guide 36 is disposed in the lubricant application device 31. The lubricant holder 35 and the solid lubricant 34 are guided by the guide 36 so that substantially the lubricant holder 35 and the solid lubricant 34 become only movable in directions that come close to or distant from with respect to the brush roller 33. That is, the lubricant holder 35 and the solid lubricant 34 become only movable in a pressing direction C by the compression coil spring 37 and a reverse direction to the pressing direction C. Therefore, the solid lubricant 34 does not oscillate greatly in a direction E orthogonal to the pressing direction C. Consequently, the solid lubricant 34 can come into contact with the brush roller 33 with a contact area that is always approximately the same, so that the lubricant of always approximately the same quantity is supplied to the image carrier surface via the brush roller 33. As a result, application irregularities of the lubricant to the image carrier surface can be prevented.

In the image forming apparatus 1 (100), as illustrated in FIG. 4, it is configured such that the lubricant holder 35 comes into contact with the pair of guide plates 40 and 41 and the solid lubricant 34 is guided by the guide 36 via the lubricant holder 35; however, it can be configured such that the solid lubricant 34 is guided directly by the guide 36. In addition, the solid lubricant 34 is guided by the guide 36 so that the solid lubricant 34 is substantially movable only in the direction C to come close to or distant from with respect to the brush roller 33. This fact indicates that the solid lubricant 34 can move freely for a certain allowance in the direction E orthogonal to the direction C.

As described above, the lubricant application device 31 includes a lubricant supply member constituted from a brush roller 33. The brush roller 33 rotates and comes into contact with the image carrier 2Y. The lubricant application device 31 also includes a solid lubricant 34 disposed opposite to the lubricant supply member and a guide 36 that guides the solid lubricant so that substantially, the solid lubricant 34 is only movable in directions that come close to or distant from with respect to the lubricant supply member. The lubricant application device 31 also includes a pressing device that presses the solid lubricant 34 with respect to the lubricant supply member. In addition, the image forming apparatus illustrated in FIG. 4 includes a lubricant leveling device constituted from a leveling blade 32. The leveling blade 32 is formed of an elastic body of rubber or the like. A tip edge part of the leveling blade 32 comes into contact with the surface of the image carrier 2Y. A base end side of the leveling blade 32 is fixed to a holder 45. The tip edge part of the leveling blade 32 slides on the surface of the image carrier 2Y. On the other hand, the lubricant supply member constituted from the above-described brush roller 33, as is clear from FIG. 4, is disposed at a more downstream side of the movement direction of the image carrier surface than the cleaning blade 28.

According to the above-described image forming apparatus 100, after toner image transfer, transferred residual toners adhering to the image carrier surface are removed by the cleaning blade 28. The surface of the image carrier 2Y turned into a cleaned state in such a way is applied with the lubricant by the brush roller 33. Next, when the applied lubricant passes through the leveling blade 32 which is in contact with the image carrier surface, the applied lubricant is uniformly pushed and spread onto the surface of the image carrier 2Y to be leveled uniformly. In such a way, a lubricant layer with a uniform thickness is formed on the image carrier. Thus, the lubricant is applied just after the image carrier 2Y is cleaned and the lubricant is applied and leveled uniformly. Therefore, occurrences of non-equitable quantities of lubricant application to the image carrier surface and non-equitable frictional coefficients of the image carrier surface can be prevented. Consequently, image qualities of images formed on the recording medium can be heightened. In addition, because the leveling blade 32 is disposed in a trailing direction with respect to the movement direction of the image carrier surface, a possibility of drive torques of the image carrier 2Y becoming excessively large can be prevented.

Embodiment 1

40 wt % of ABS resin (GR-3000, manufactured by Denki Kagaku Kogyo K. K.) and 60 wt % of polyether-ester-amide (IRGASTAT P18, manufactured by Ciba Specialty Chemicals Inc.) are blended as a resin composition. 4 phr of polycarbonate-glycidyl methacrylate-styrene-acrylonitrile copolymer (MODIPER-CL440-G, manufactured by NOF corp.) is added to 100 phr of the resin composition by melting and kneading so that a molten resin composition can be obtained. And the molten resin composition is injection-molded onto a support body (10 mm external diameter) formed of a SUM 22 (processed with Ni plating) to form an electrical resistance adjustment layer, and gate cutting and length adjustment are performed on the electrical resistance adjustment layer. Then a ring shaped spacing member formed of a high-density polyethylene resin (NOVATEC-PP HY540, manufactured by Japan Polypropylene Corp.) is press-fitted to both end parts of the electrical resistance adjustment layer. A roller is obtained by simultaneously cutting an external diameter of the spacing member to 12.54 mm and an external diameter of the electrical resistance adjustment layer to 12.40 mm. Next, a coating material made from 100 g of an acrylic silicone resin (3000VH-P, solid content 38%, manufactured by Kawakami Paint Mfg. Co., Ltd.), 96 g of a polyether polyol resin (Exenol E540, quantity of ethylene oxide 40 wt %, solid content 100%, manufactured by Asahi Glass Co., Ltd.), 58 g of an isocyanate resin (T4 hardener, manufactured by Kawakami Paint Mfg. Co., Ltd.), 0.9 g of an organic salt catalyst (U-CAT SA1, solid content 100%), 50 g of a bis (trifluoromethane) sulfonyl imide acid lithium butyl acetate solution (solid content 20%, made by Sanko Chemical Industry Corp.) and 3.7 g of a carbon dispersion liquid (REC-SM-23, solid content 25%, manufactured by Resino Color Industry, Co., Ltd.) is diluted by a diluting solvent made from 320 g of butyl acetate and 36 g of MEK (Methyl Ethyl Ketone). The coating material then forms an intermediate layer of a film thickness of about 10 μm on the surface of the electrical resistance adjustment layer in the roller by spray coating. Next, 300 g of a coating material made from an acrylic-modified silicon resin (Mukicoat 3000VH, manufactured by Kawakami Paint Mfg. Co., Ltd.) and an isocyanate resin (T4 hardener, manufactured by Kawakami Paint Mfg. Co., Ltd.) mixed at ratio of 5:1 is diluted by a diluting solvent made from 150 g of butyl acetate and then forms a surface layer of a film thickness of about 5 μm on the surface of the intermediate layer by spray coating. Subsequently, the intermediate layer and the surface layer are heated for 90 minutes in an air-heating furnace at 105° C. and hardened. As a result, a charging member (charger roller) with about a 55 μm difference formed between a gap forming part and the surface layer is obtained.

Embodiment 2

A charging member is obtained by the same method as Embodiment 1, except for forming the surface layer to a thickness of 10 μm by a coating material made from a fluorine-based resin (Saafukyua DSC-201, manufactured by Daido Corp.) and an isocyanate-based hardener (Saafukyua, manufactured by Daido Corp.) mixed at ratio of 3:1.

Embodiment 3

A charging member is obtained by the same method as Embodiment 1, except for forming the surface layer to a thickness of 15 μm by a coating material made from a fluorine-based resin (Fkuria KD270, manufactured by Kanto Denka Kogyo Co., Ltd.) and an isocyanate-based hardener (LTI, manufactured by Kyowa Hakko Chemical Co., Ltd.) mixed at ratio of 100:5.8.

Embodiment 4

A charging member is obtained by the same method as Embodiment 1, except for forming the surface layer to a thickness of 15 μm by a coating material made from 4 phr of an acrylic urethane (Oofrekks No. 800 (N) (CG), manufactured by Ohashi Chemical Industries, Ltd.) and a hardener (LTI, manufactured by Kyowa Hakko Chemical Co., Ltd.) mixed at ratio of 4:1.

Comparative Example 1

A charging member is obtained by the same as Embodiment 1, except for not forming the surface layer.

Comparative Example 2

A charging member is obtained by the same as Embodiment 1, except for forming the surface layer to a thickness of 17 μm by a coating material made from a urethane (Resamine NE-302HV, manufactured by Dainichiseika Color & Chemicals Mfg. Co., Ltd.).

Comparative Example 3

A charging member is obtained by the same method as Embodiment 1, except for forming the surface layer to a thickness of 18 μm by a coating material made from a urethane (Exenol 230, manufactured by Asahi Glass Co., Ltd.), an acrylic-modified silicon resin (Mukicoat 3000VH, manufactured by Kawakami Paint Mfg. Co., Ltd.) and an isocyanate-based hardener (T4, manufactured by Kawakami Paint Mfg. Co., Ltd.) mixed at ratio of 55:15:30.

Figure 7:
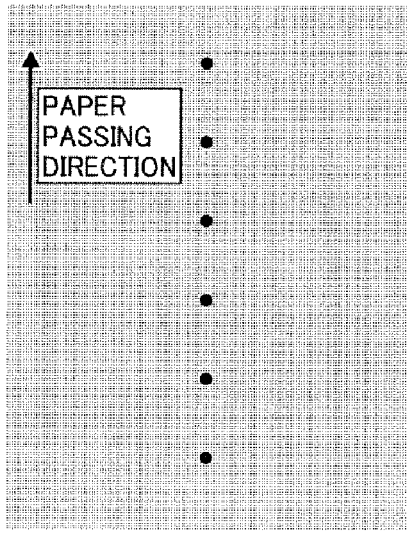
FIG. 7 is a diagram of pitch spot in a charger roller.
Figure 8:
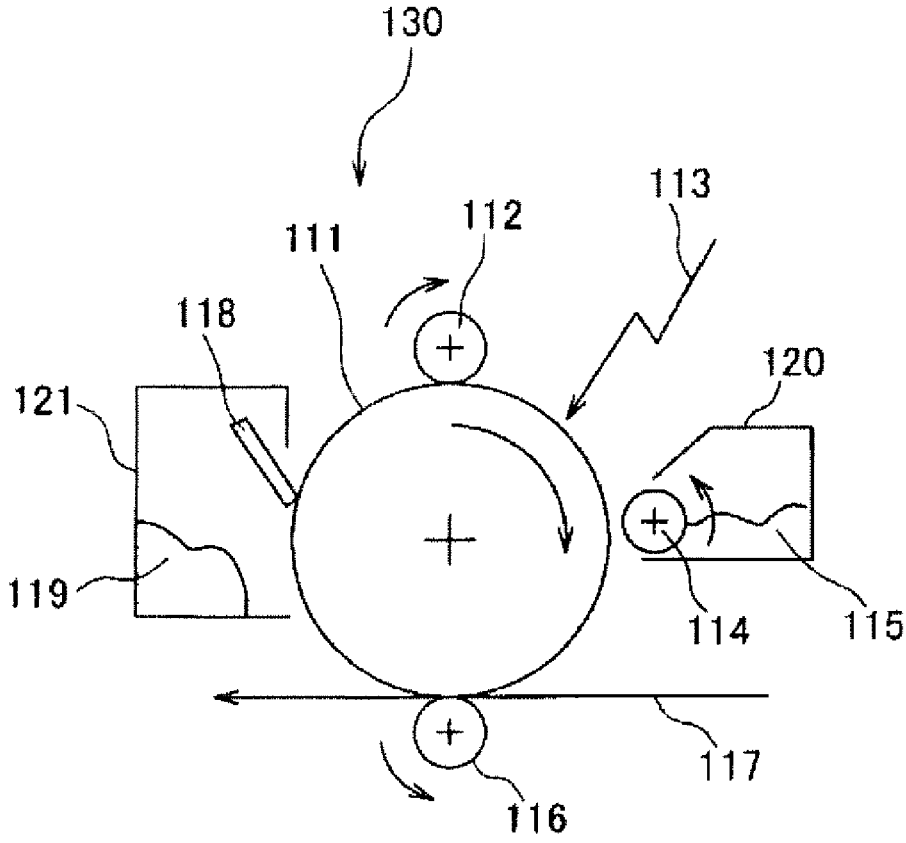
FIG.8 Prior Art
FIG. 8 is a schematic explanatory diagram of a conventional image forming apparatus.

A maximum impression depth: $H_{max}$ (μm) and a maximum static friction coefficient of the charging members (charger rollers) obtained by Embodiments 1 to 4 and comparative examples 1 to 3 are measured. After resin powders of less than or equal to ϕ1 mm are adhered to surfaces of the charging members (charger rollers) obtained by Embodiments 1 to 4 and Comparative examples 1 to 3, the charging member to which the resin powders are adhered is mounted on the process cartridge illustrated in FIG. 4, and then the process cartridge is mounted on the image forming apparatus illustrated in FIG. 3 (ImagioMP C3000, manufactured by Ricoh, Co., Ltd.). And the image forming apparatus continuously outputs 10 sheets (A3 size) of 1×1 dot halftone image of 600 dpi, and an occurrence of dark roller pitch spots in the halftone image (an occurrence state of spot is illustrated in FIG. 7.) is checked by eye, and an abnormal image due to an adherence of foreign substance is evaluated.

Evaluation criteria of the abnormal image due to the adherence of foreign substance are as follows.

○ (circle) indicates that roller pitch spots disappear within 10 sheets.

Δ (triangle) indicates that the number of roller pitch spots is less than 5 at a 10th sheet.

x (x-mark) indicates that the number of roller pitch spots is equal to or more than 5 at a 10th sheet.

○ (circle) and Δ (triangle) are practically allowed.

A measurement result of the abnormal image due to the adherence of foreign substance is described in following Table 1.

TABLE 1

| | maximum impression depth $H_{max}$ (μm) | maximum static friction coefficient | abnormal image due to adherence of foreign substance (roller pitch spot) |
|---|---|---|---|
| Embodiment 1 | 1.5 | 0.19 | ○ |
| Embodiment 2 | 2.0 | 0.20 | ○ |
| Embodiment 3 | 2.3 | 0.20 | ○ |
| Embodiment 4 | 2.8 | 0.34 | ○ |
| Comparative example 1 | 6.5 | 1.22 | x |
| Comparative example 2 | 6.0 | 1.08 | x |
| Comparative example 3 | 4.5 | 0.61 | x |

According to embodiments of the present invention, it is possible to provide a charging member which can prevent an occurrence of abnormal image due to a burial of a foreign substance onto a surface of the charging member even when the foreign substance is interposed in a minute gap between an image carrier and the charging member, because the surface layer becomes harder than the intermediate layer.

According to embodiments of the present invention, it is possible to provide a charging member which is further difficult to produce an abnormal electrical discharge in a case where a minute gap between an image carrier and the charging member is widened, because an electrical resistance of the charging member makes it lower.

According to embodiments of the present invention, it is possible to provide a charging member which is further difficult to produce an abnormal electrical discharge in a case where a minute gap between an image carrier and the charging member is widened, because a low electrical resistance of the charging member makes it realized.

According to embodiments of the present invention, it is possible to easily obtain an intermediate layer in which a low electrical resistance is realized and provide a charging member which is further difficult to produce an abnormal electrical discharge, because even when a ratio of the polyether is heightened, the hardening reaction becomes heightened According to embodiments of the present invention, it is possible to prevent an occurrence of abnormal image, because an adherence of a foreign substance onto a surface of a charging member is reduced and a foreign substance getting trapped in a gap between an image carrier and the charging member is prevented.

According to embodiments of the present invention, it is possible to prevent an occurrence of abnormal image, because an adherence of a foreign substance onto a surface of a charging member is reduced and a foreign substance getting trapped in a gap between an image carrier and the charging member is prevented.

According to embodiments of the present invention, it is possible to prevent an occurrence of abnormal image, because a poor electrical charge due to insulation is prevented and an adherence of a foreign substance onto a surface of a charging member is prevented According to embodiments of the present invention, it is further difficult for a residual substance such as a toner which remains on a surface of an image carrier to adhere to a surface of a charging member.

According to embodiments of the present invention, it is possible to provide a charging device which can prevent an occurrence of abnormal image due to a burial of a foreign substance onto a surface of the charging member even when the foreign substance is interposed in a minute gap between an image carrier and the charging member.

According to embodiments of the present invention, it is possible to provide a process cartridge which can prevent an occurrence of abnormal image due to a burial of a foreign substance onto a surface of the charging member even when the foreign substance is interposed in a minute gap between an image carrier and the charging member, and in which a replacement is simplified while a gap between an image carrier and a charging member is precisely maintained and user maintenance is possible.

According to embodiments of the present invention, it is possible to provide an image forming apparatus which can prevent an occurrence of abnormal image due to a burial of a foreign substance onto a surface of the charging member even when the foreign substance is interposed in a minute gap between an image carrier and the charging member and can obtain stable images over a long time period.

Although the present invention has been described in terms of exemplary embodiments, it is not limited thereto. It should be appreciated that variations may be made in the embodiments described by persons skilled in the art without departing from the scope of the present invention as defined by the following claims.

What is claimed is:

1. A charging member, comprising:

an electrically-conductive support;

an electrical resistance adjustment layer having ion conductivity provided on the electrically-conductive support;

an intermediate layer having ion conductivity provided on the electrical resistance adjustment layer; and a surface layer having insulation provided on the intermediate layer, wherein the intermediate layer is formed of a resin composition containing at least a polyether polyol resin, and the surface layer is formed of a resin composition containing at least one of a fluorine-based resin, a silicone-based resin, a polyamide resin, a polyester resin, and a urethane resin, and wherein a maximum static friction coefficient of the surface layer is less than or equal to 0.5.

2. The charging member according to claim 1, wherein the polyether polyol resin is contained at ratio of 30-60 wt % with respect to the entire resin forming the intermediate layer.

3. The charging member according to claim 1, wherein a contained quantity of polyether in the polyether polyol resin is 10-40 wt in ethylene oxide conversion.

4. The charging member according to claim 1, wherein the resin forming the intermediate layer is hardened in the presence of catalysts made from organic acid salts of diazabicycloundecene or diazahicyclononene.

5. The charging member according to claim 1, wherein a maximum impression depth ($H_{max}$) of the surface layer is less than or equal to 3 μm.

6. The charging member according to claim 1, wherein a thickness of the surface layer is less than or equal to 5-15 μm.

7. The charging member according to claim 1, further comprising:

a ring shaped spacing member, wherein the ring shaped spacing member forms a certain minute gap by contacting an image carrier, and is provided at both end parts of the charging member.

8. A charging device comprising: the charging member according to claim 1.

9. A process cartridge which is fixed to a main body of an image forming apparatus to be freely detachable, comprising:

the charging device according to claim 8, and an image carrier, wherein the charging member and the image carrier are supported integrally.

10. An image forming apparatus, comprising:

the process cartridge according to claim 9;

an exposure device which exposes and forms an electrostatic latent image on a surface of an image carrier;

an image development device which visualizes the electrostatic latent image on the surface of the image carrier by supplying toners; and a transfer device which transfers onto a transfer medium the visualized electrostatic latent image on the surface of the image carrier.

* * * * *

UNITED STATES PATENT AND TRADEMARK OFFICE

CERTIFICATE OF CORRECTION

PATENT NO. : 8,385,780 B2
APPLICATION NO. : 12/709874
DATED : February 26, 2013
INVENTOR(S) : Makoto Nakamura et al.

It is certified that error appears in the above-identified patent and that said Letters Patent is hereby corrected as shown below:

Replace the Inventor's information on the Title page of the patent with the following:

-- (75) Inventors: Makoto Nakamura, Ebina (JP); Yutaka Narita, Sagamihara (JP);
Tadayuki Oshima, Atsugi (JP); Hiroki Furubayashi, Atsugi (JP);
Taisuke Tokuwaki, Sagamihara (JP) --

Signed and Sealed this
Thirteenth Day of August, 2013

Teresa Stanek Rea
*Acting Director of the United States Patent and Trademark Office*